US012677900B2

(12) United States Patent
Yarlagadda et al.

(10) Patent No.: US 12,677,900 B2
(45) Date of Patent: Jul. 14, 2026

(54) SAFETY HELMET

(71) Applicant: Honeywell Safety Products USA, Inc., Charlotte, NC (US)

(72) Inventors: Prudhvi Krishna Yarlagadda, Charlotte, NC (US); Ramesh Kannan Mariyappan, Charlotte, NC (US); Travis William Mikalauskas, Charlotte, NC (US); Nancy Casillas Owens, Charlotte, NC (US)

(73) Assignee: Honeywell Safety Products USA, Inc., Latham, NY (US)

( * ) Notice: Subject to any disclaimer, the term of this patent is extended or adjusted under 35 U.S.C. 154(b) by 0 days.

(21) Appl. No.: 19/178,305

(22) Filed: Apr. 14, 2025

(65) Prior Publication Data

US 2025/0338912 A1 Nov. 6, 2025

(30) Foreign Application Priority Data

May 2, 2024 (IN) ..... 202411034873

(51) Int. Cl.
*A42B 3/18* (2006.01)

(52) U.S. Cl.
CPC ..... *A42B 3/185* (2013.01)

(58) Field of Classification Search
CPC ..... A42B 3/185; G02C 3/02
See application file for complete search history.

(56) References Cited

U.S. PATENT DOCUMENTS

| | | | | |
|---|---|---|---|---|
| 9,788,592 | B2 * | 10/2017 | Cheng | A42B 3/222 |
| 10,842,217 | B2 * | 11/2020 | Smallwood | A42B 3/12 |
| 2009/0235437 | A1 * | 9/2009 | Springer | G02C 3/02 2/10 |
| 2011/0265237 | A1 * | 11/2011 | Lazar | A42B 3/185 2/10 |
| 2013/0219599 | A1 * | 8/2013 | Garcia | A42B 3/22 2/424 |
| 2013/0312164 | A1 * | 11/2013 | Ko | A42B 3/226 2/422 |
| 2020/0367594 | A1 * | 11/2020 | Daburn | A42B 3/185 |
| 2025/0000195 | A1 * | 1/2025 | Rogers | A42B 3/223 |

* cited by examiner

*Primary Examiner* — Katherine M Moran
(74) *Attorney, Agent, or Firm* — Fredrikson & Byron, P.A.

(57) ABSTRACT

A safety helmet is disclosed. The safety helmet comprises an outer shell, an inner block coupled to or monolithic with the outer shell, an eyewear, at least one lever. Further, the at least one lever is configured to move from a first position to a second position. Further, the inner block protrusion acts as a stopper for the at least one lever. Further, the eyewear is configured to move from a stowed-in position to a stowed-out position. Further, when the eyewear is in the stowed-in position and the at least one lever is in the first position, the at least one lever locks the eyewear in the stowed-in position. Further, when the eyewear is in the stowed-in position and the at least one lever is moved from the first position to the second position, the eyewear is allowed to move to the stowed-out position.

19 Claims, 15 Drawing Sheets

SAFETY HELMET

CROSS-REFERENCE TO RELATED APPLICATION

This application claims priority pursuant to 35 U.S.C. 119(a) to Indian application Ser. No. 2012411034873, filed May 2, 2024, which application is incorporated herein by reference in its entirety.

TECHNOLOGICAL FIELD

Example embodiments of the present disclosure relate generally to a protective helmet, and more particularly to a safety helmet and method for protecting a user's head and eyes from various hazards.

BACKGROUND

In various industrial applications a safety helmet is an important component of personal protective equipment (PPE). The safety helmet is provided to the workers in various industrial arenas such as production facilities, utilities, and industrial settings. Some of the present safety helmets are provided with safety eyewear. The safety eyewear is employed to protect the worker's eyes while performing one or more operations that may require protection to the worker's eyes. The safety eyewear affixed with the helmet use a frictional locking principle, which may require significant operating force to shift the eyewear. Further, after repeated wear and tear, the frictional locking principle causes unwanted drops of the eyewear thereby increasing eyewear operation failure.

The inventors have identified numerous areas of improvement in the existing technologies and processes, which are the subjects of embodiments described herein. Through applied effort, ingenuity, and innovation, many of these deficiencies, challenges, and problems have been solved by developing solutions that are included in embodiments of the present disclosure, some examples of which are described in detail herein.

BRIEF SUMMARY

The following presents a summary of some example embodiments to provide a basic understanding of some aspects of the present disclosure. This summary is not an extensive overview and is intended to neither identify key or critical elements nor delineate the scope of such elements. It will also be appreciated that the scope of the disclosure encompasses many potential embodiments in addition to those here summarized, some of which will be further described in the detailed description that is presented later.

In an example embodiment, a safety helmet is disclosed. The safety helmet comprising an outer shell, an inner block coupled to or monolithic with the outer shell. Further the inner block comprises an inner block protrusion. Further, an eyewear is pivotally mounted to the inner block and positioned between the outer shell and the inner block. Further, at least one lever having a push protrusion and a stopper protrusion, an eyewear pivotally mounted to the inner block and positioned between the outer shell and the inner block, at least one lever pivotally mounted to the inner block and positioned proximate to the eyewear. Further, the at least one lever is configured to move from a first position to a second position. Further, the inner block protrusion acts as a stopper for the at least one lever. Further, the eyewear is configured to move from a stowed-in position to a stowed-out position. Further, when the eyewear is in the stowed-in position and the at least one lever is in the first position, the at least one lever locks the eyewear in the stowed-in position. Further, when the eyewear is in the stowed-in position and the at least one lever is moved from the first position to the second position, the eyewear is allowed to move to the stowed-out position.

In some embodiments, the eyewear defines an eyewear rotational axis on which the eyewear rotates from the stowed-in position to the stowed-out position or from the stowed-out position to the stowed-in position. In some embodiments, the inner block is fabricated with a groove. Further, the groove is configured to restrict further movement of the eyewear on the eyewear rotational axis when deployed in the stowed-out position.

In some embodiments, a protrusion configured to prevent a rotational movement of the eyewear on the eyewear rotational axis above a predefined threshold angle, when the eyewear moves from the stowed-out position to the stowed-in position. In some embodiments, the at least one lever defines a lever rotational axis on which the at least one lever rotates from the first position to the second position or from the second position to the first position.

In some embodiments, the inner block protrusion is configured to prevent a rotational movement of the at least one lever on the lever rotational axis above a threshold angle, when the at least one lever is pushed from the first position to the second position. In some embodiments, a first spring coupled to the eyewear. Further, the first spring is configured to push the eyewear from the stowed-in position to the stowed-out position once the at least one lever is rotated from the first position to the second position.

In some embodiments, a second spring coupled to the at least one lever. Further, the second spring is configured to retract the at least one lever from the second position to the first position once the eyewear is deployed in the stowed-out position. In some embodiments, the at least one lever defines a lever rotational axis on which the at least one lever rotates from the first position to the second position or from the second position to the first position. Further, the eyewear defines an eyewear rotational axis on which the eyewear rotates from the stowed-in position to the stowed-out position or from the stowed-out position to the stowed-in position. Further, the lever rotational axis is orthogonal to the eyewear rotational axis.

In some embodiments, each end of the eyewear is fabricated with a slot. Further, the slot is configured to receive an extended region of an adaptor to detachably couple each end of the eyewear with the adaptor. In some embodiments, the adaptor is configured to detachably mount the eyewear with the inner block. In some embodiments, the at least one lever further comprises a push protrusion and a stopper protrusion. Further, the push protrusion is configured to be pushed to rotate the at least one lever from the first position to the second position and the stopper protrusion is configured to lock with the inner block protrusion to lock the movement of the at least one lever.

In another example embodiment, a method is disclosed. The method comprises steps of moving at least one lever from a first position to a second position, where an inner block protrusion acts as a stopper for the at least one lever. Further, an eyewear is configured to move from a stowed-in position to a stowed-out position. Further, when the eyewear is in the stowed-in position and the at least one lever is in the first position, the at least one lever locks the eyewear in the stowed-in position. Further, when the eyewear is in the stowed-in position and the at least one lever is moved from the first position to the second position, the eyewear is allowed to move to the stowed-out position. The method further comprises steps of pushing the eyewear from the stowed-out position to the stowed-in position to move the at least one lever from the second position to the first position to lock the eyewear in the stowed-in position.

The above summary is provided merely for the purpose of summarizing some example embodiments to provide a basic understanding of some aspects of the present disclosure. Accordingly, it will be appreciated that the above-described embodiments are merely examples and should not be construed to narrow the scope or spirit of the present disclosure in any way. It will be appreciated that the scope of the present disclosure encompasses many potential embodiments in addition to those here summarized, some of which will be further described below.

BRIEF DESCRIPTION OF THE DRAWINGS

Figure 1A:
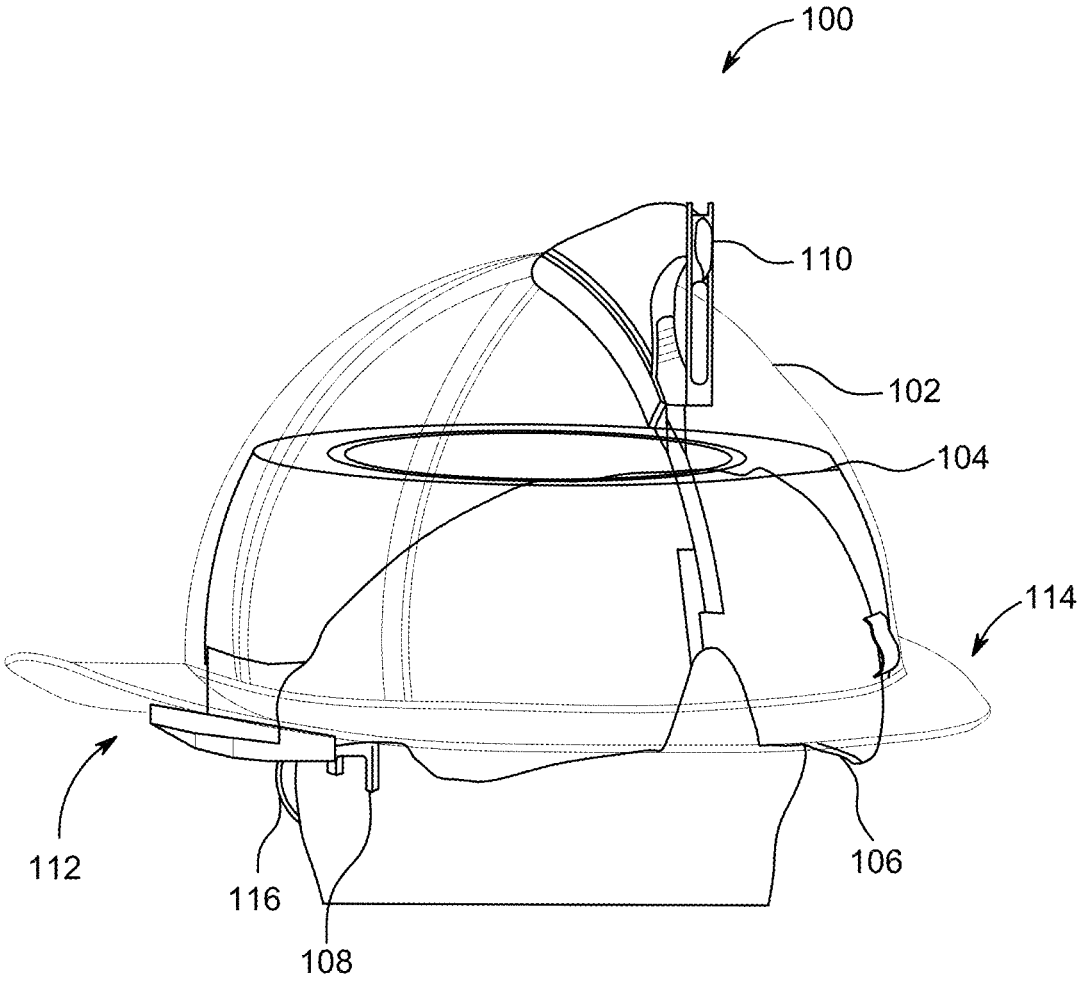
Figure 1B:
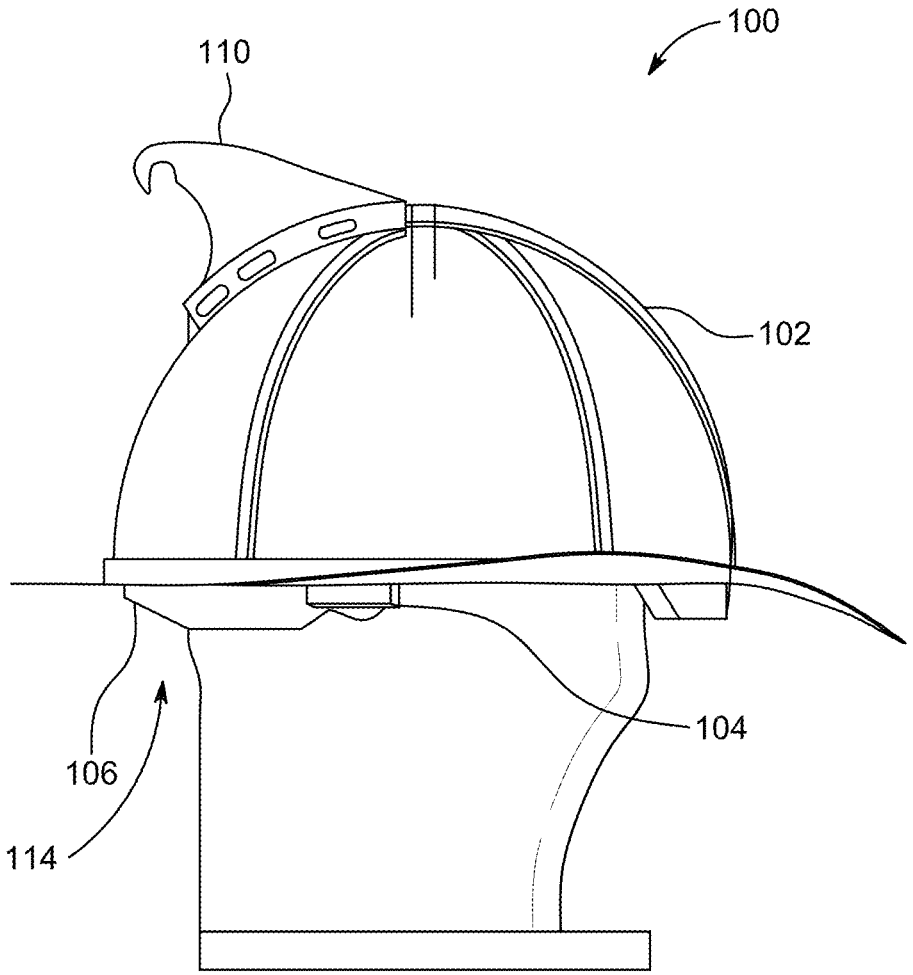
Figure 1C:
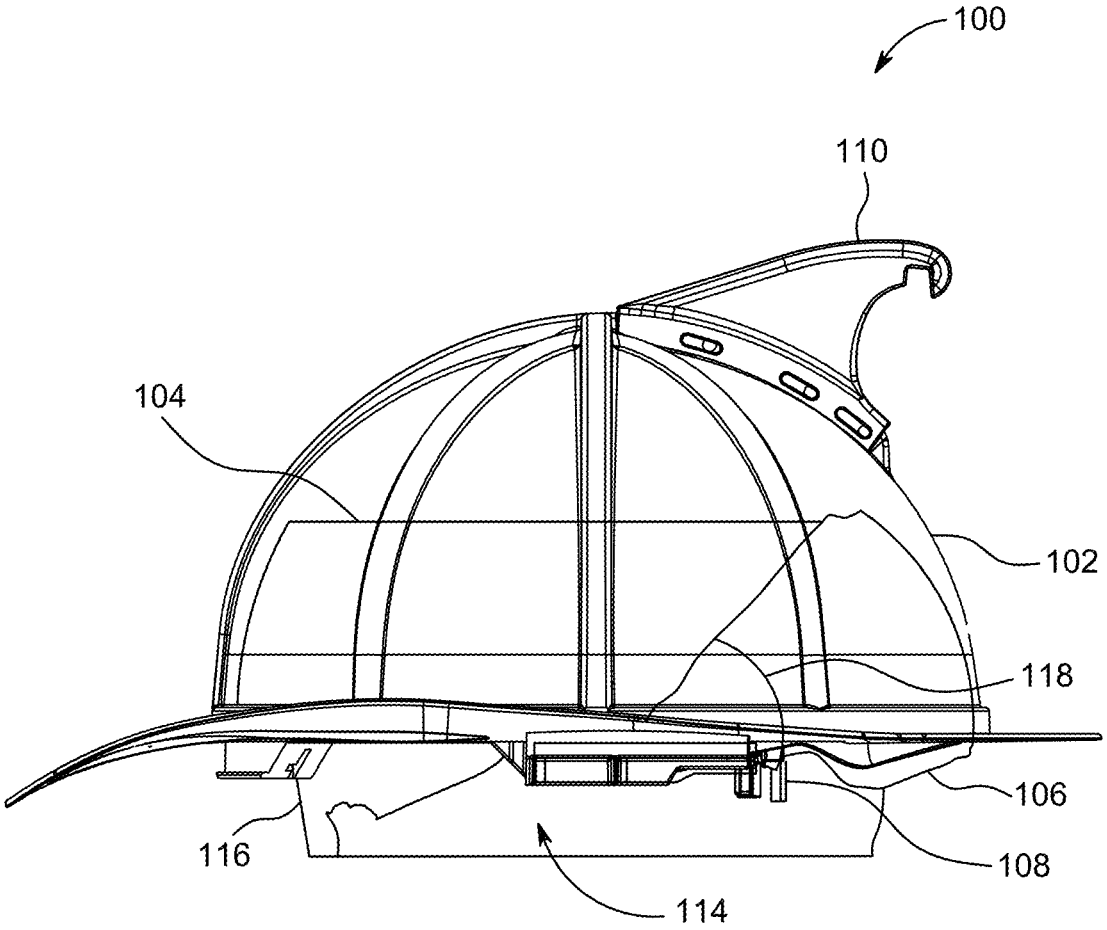
Figure 2A:
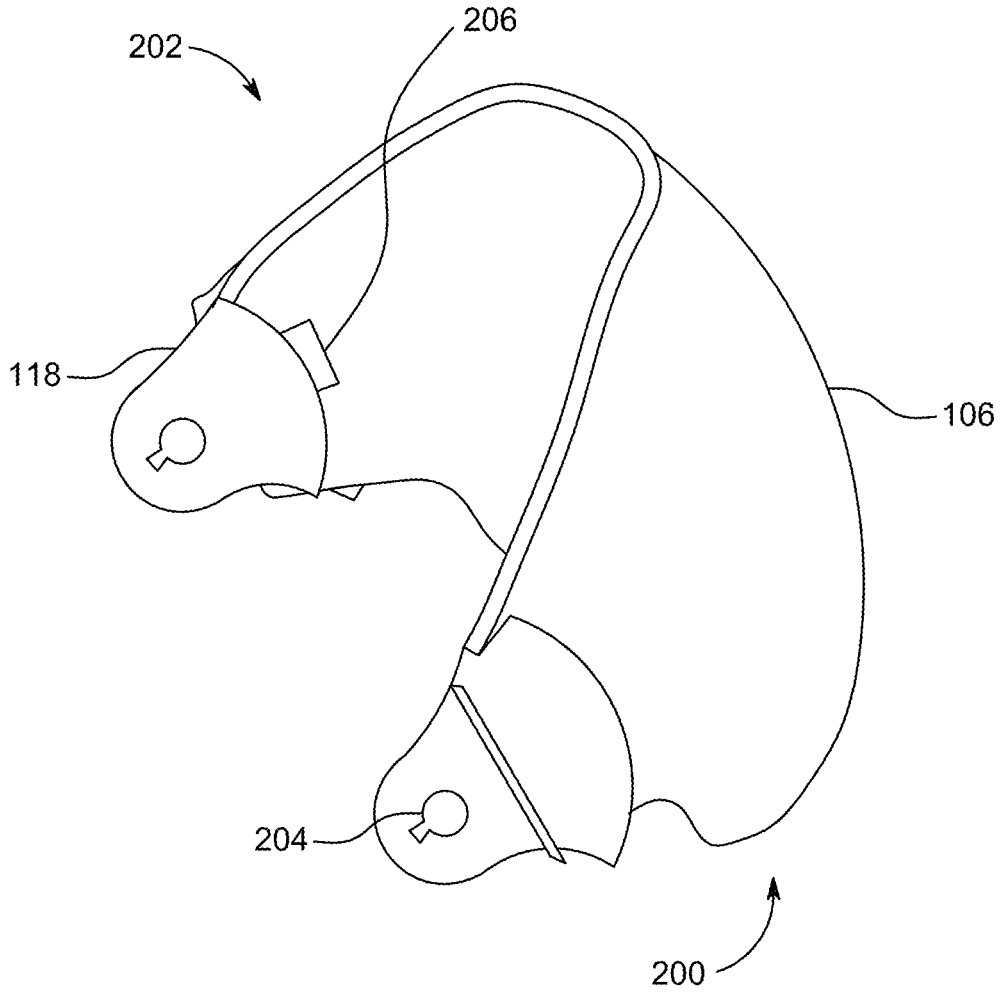
Figure 2B:
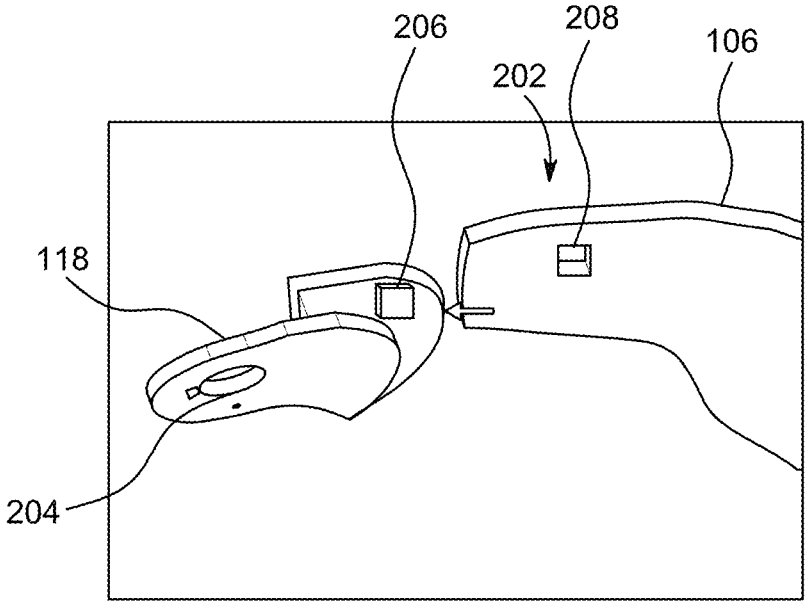
Figure 3A:
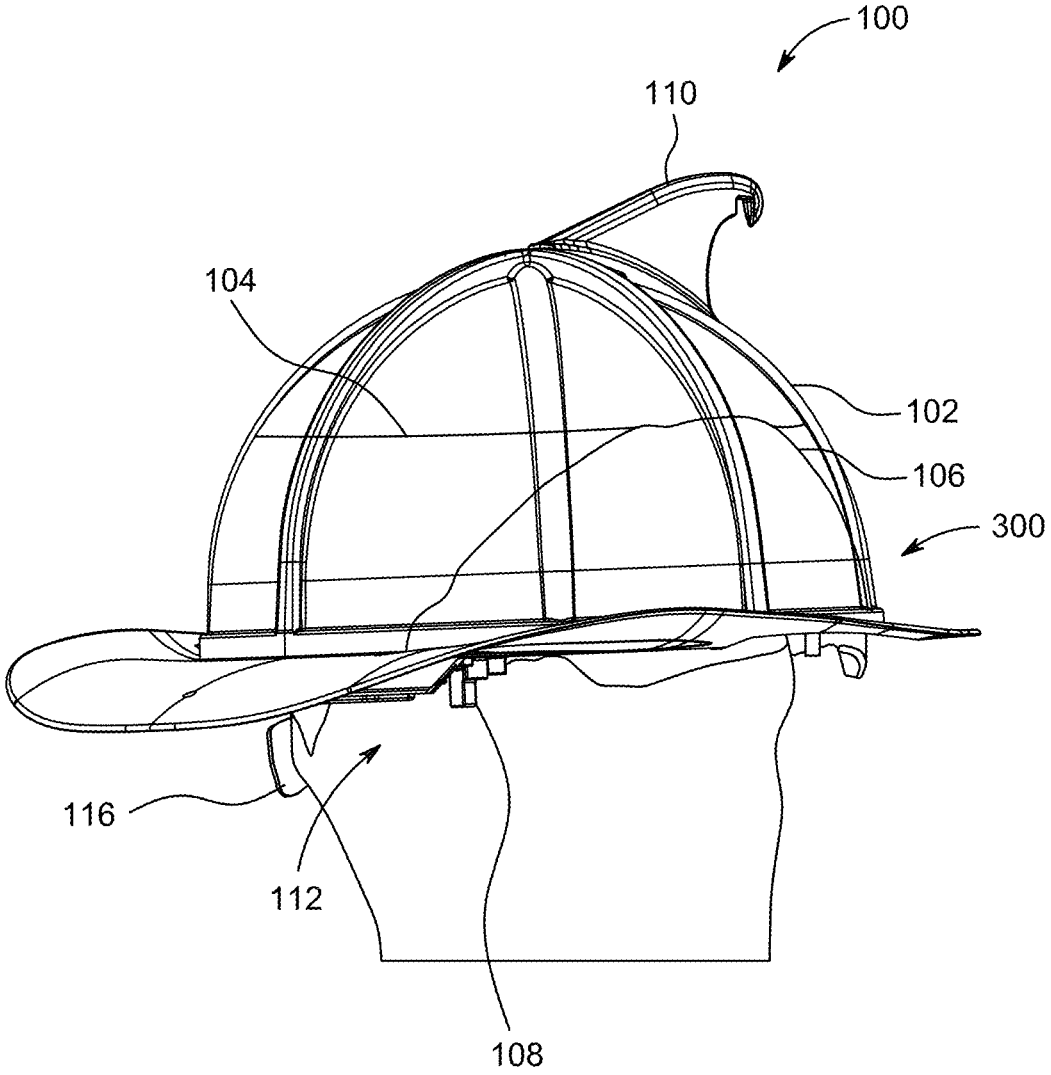
Figure 3B:
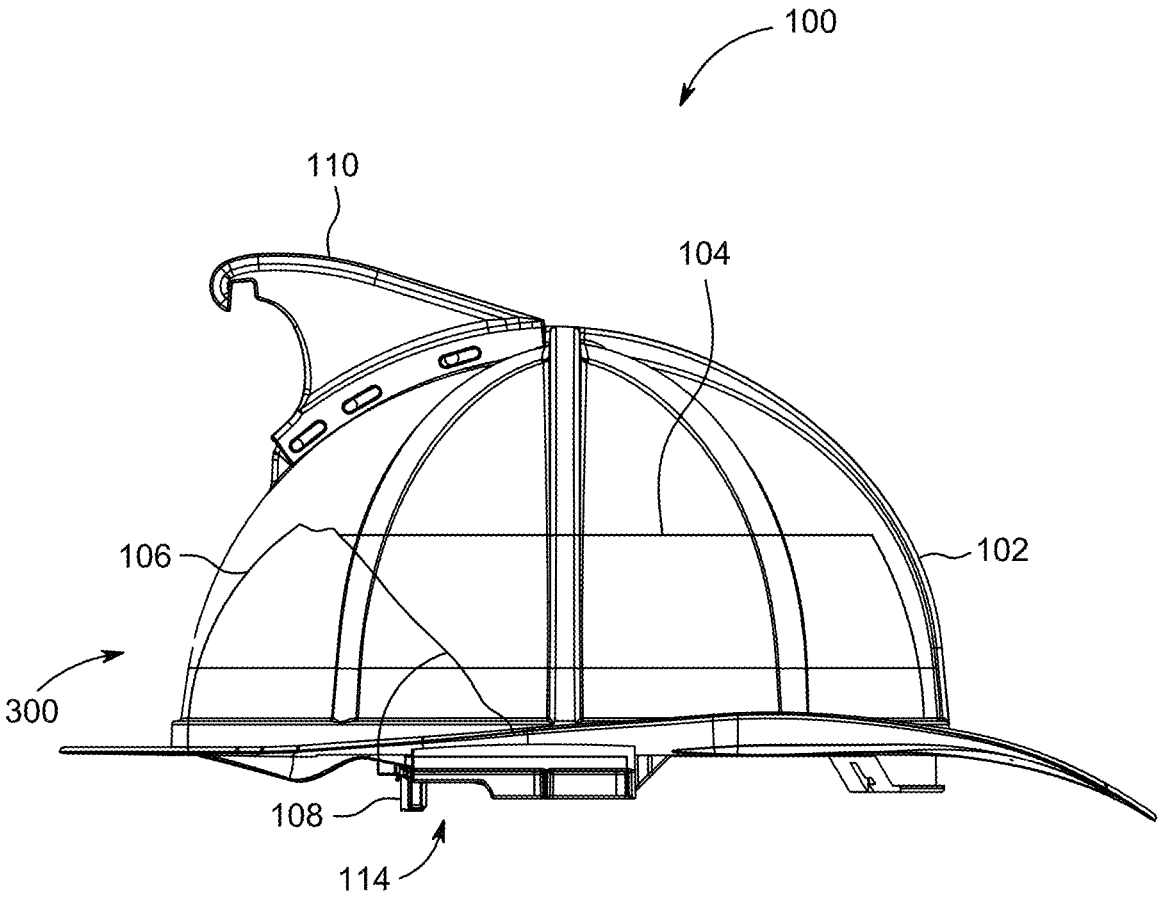
Figure 3C:
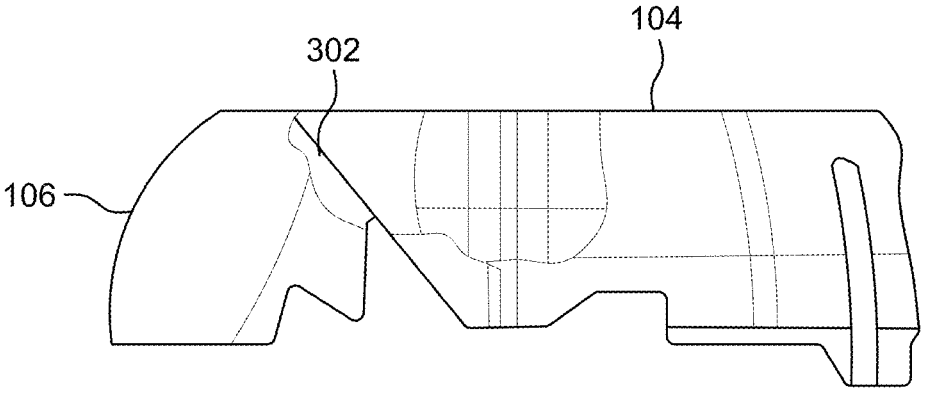
Figure 3D:
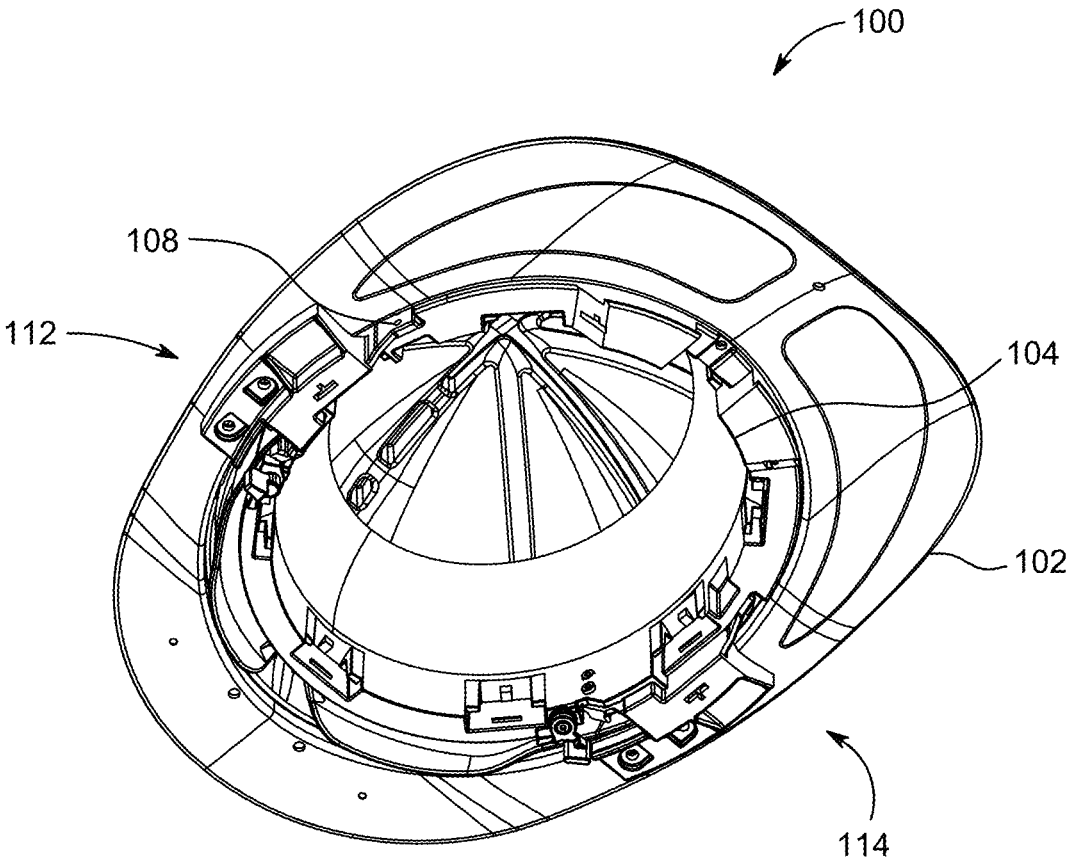
Figure 4A:
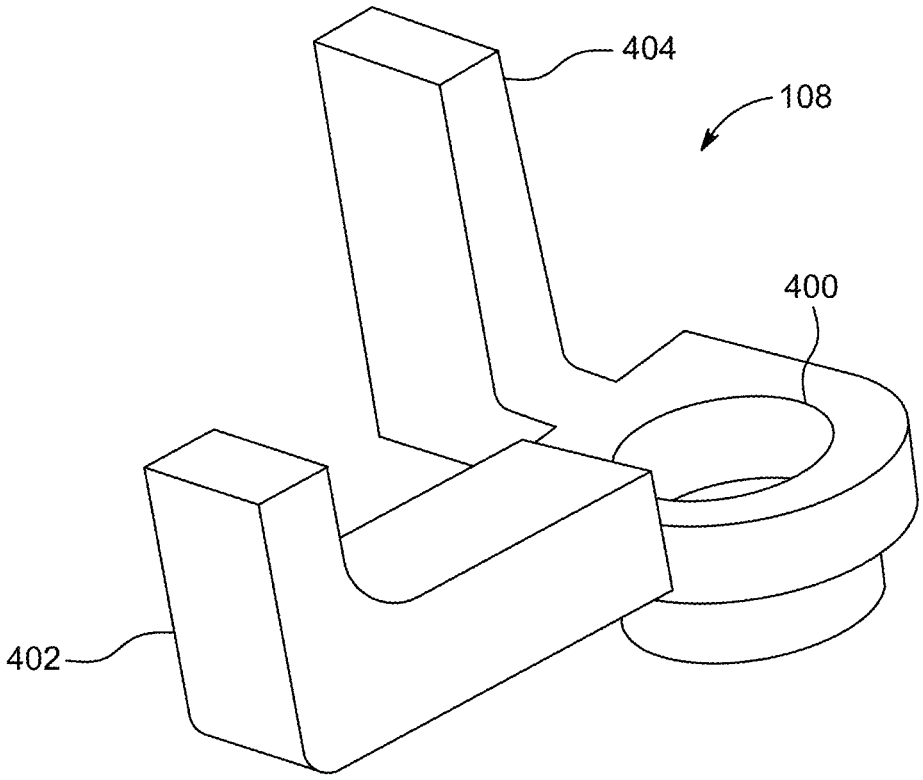
Figure 4B:
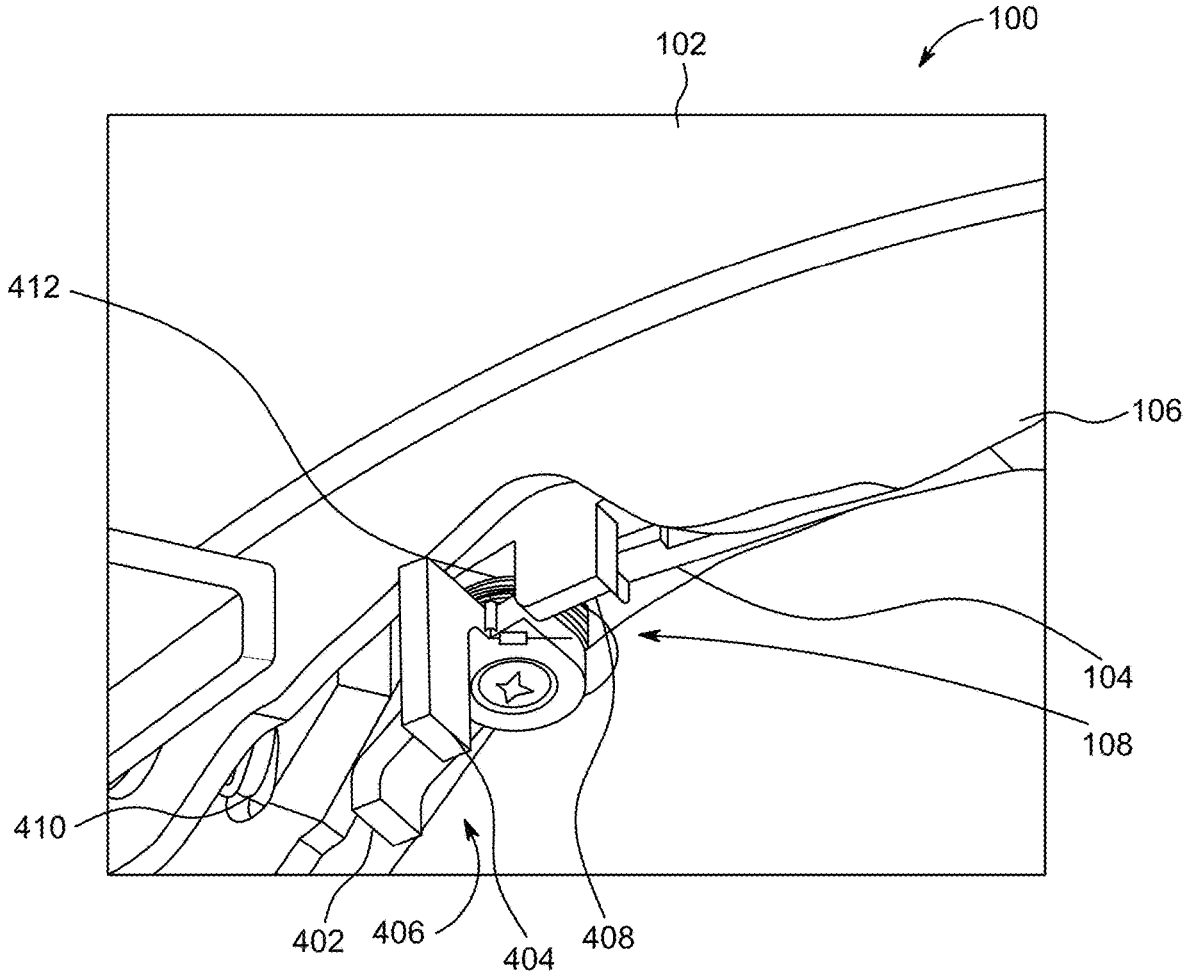
Figure 5A:
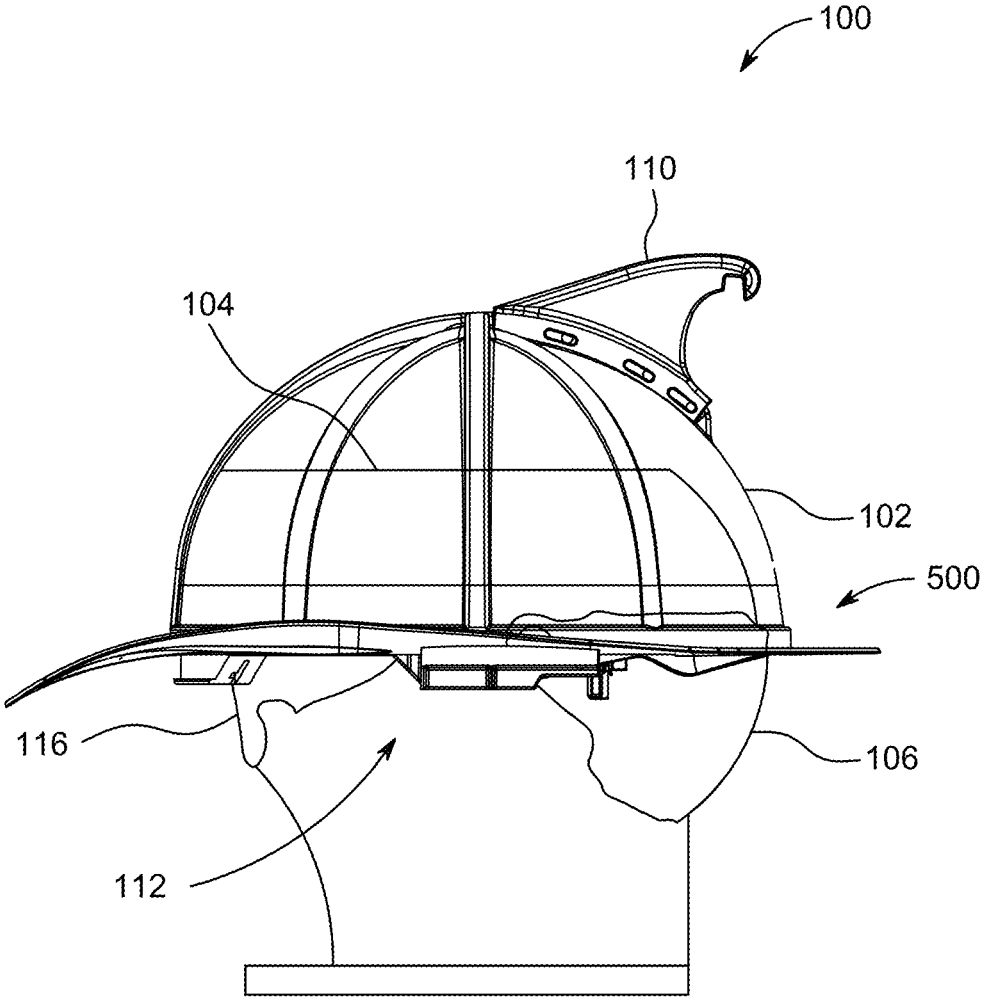
Figure 5B:
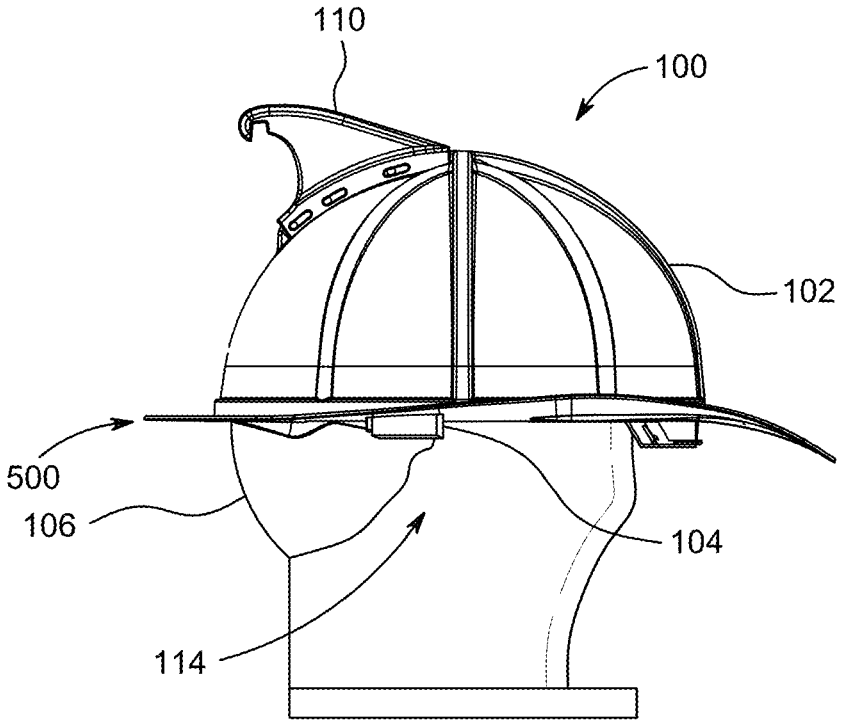
Figure 5C:
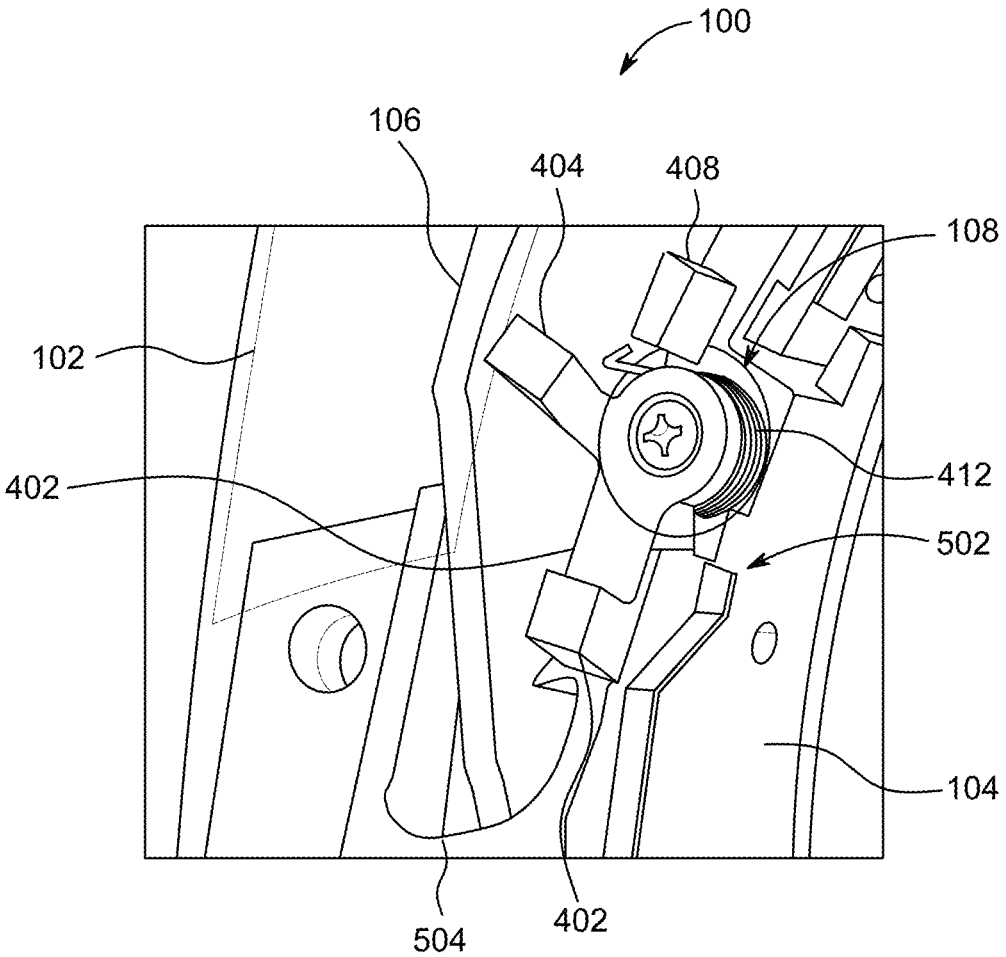
Figure 5D:
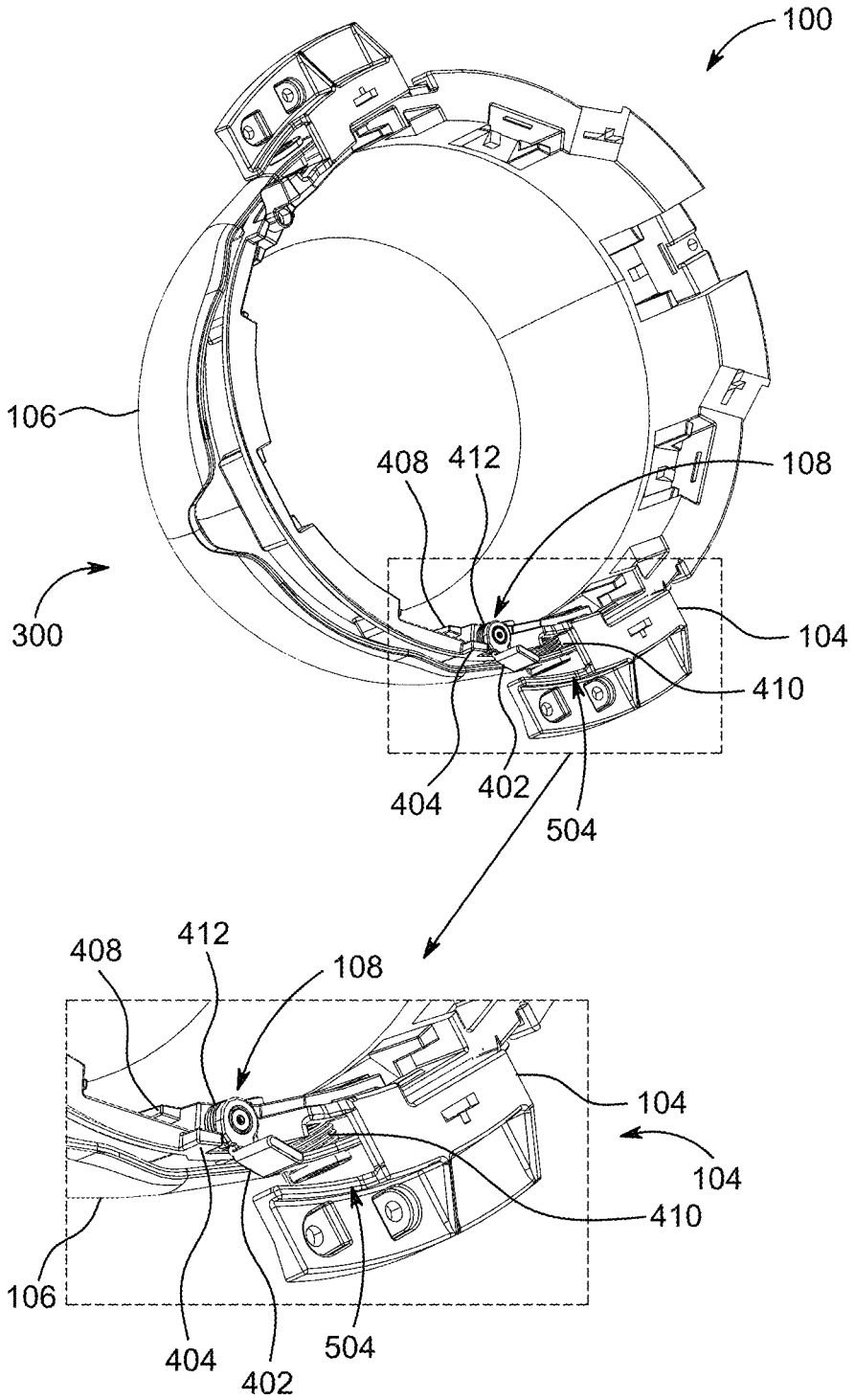

Having thus described certain example embodiments of the present disclosure in general terms, reference will hereinafter be made to the accompanying drawings, which are not necessarily drawn to scale, and wherein:

FIG. 1A illustrates a perspective view of a safety helmet in accordance with an example embodiment of the present disclosure;

FIG. 1B illustrates a side view of the safety helmet in accordance with an example embodiment of the present disclosure;

FIG. 1C illustrates another side view of the safety helmet in accordance with an example embodiment of the present disclosure;

FIG. 2A a perspective view of the eyewear detachably coupled with the adaptor in accordance with an example embodiment of the present disclosure;

FIG. 2B illustrates an exploded view of the eyewear detached from the adaptor in accordance with an example embodiment of the present disclosure;

FIG. 3A illustrates another perspective view of the safety helmet having the eyewear positioned at a stowed-in position in accordance with an example embodiment of the present disclosure;

FIG. 3B illustrates a side view of the safety helmet having the eyewear gripped by a protrusion when positioned at the stowed-in position in accordance with an example embodiment of the present disclosure;

FIG. 3C illustrates a side view of the eyewear while gripped by the protrusion at the stowed-in position in accordance with an example embodiment of the present disclosure;

FIG. 3D illustrates a bottom view of the safety helmet having the eyewear positioned at the stowed-in position in accordance with an example embodiment of the present disclosure;

FIG. 4A illustrates a perspective view of at least one lever in accordance with an example embodiment of the present disclosure;

FIG. 4B illustrates a bottom view of the at least one lever configured in a first position when the eyewear is positioned at the stowed-in position in accordance with an example embodiment of the present disclosure;

FIG. 5A illustrates a side view of the safety helmet having the eyewear positioned at a stowed-out position in accordance with an example embodiment of the present disclosure;

FIG. 5B illustrates another side view of the safety helmet having the eyewear positioned at the stowed-out position in accordance with an example embodiment of the present disclosure;

FIG. 5C illustrates another bottom view of the at least one lever configured in the second position when the eyewear is positioned at the stowed-out position in accordance with an example embodiment of the present disclosure; and, FIG. 5D illustrates a magnified view of the safety helmet in accordance with an example embodiment of the present disclosure.

DETAILED DESCRIPTION

Some embodiments will now be described more fully hereinafter with reference to the accompanying drawings, in which some, but not all, embodiments of the present disclosure are shown. Indeed, various embodiments may be embodied in many different forms and should not be construed as limited to the embodiments set forth herein; rather, these embodiments are provided so that this disclosure will satisfy applicable legal requirements.

The components illustrated in the figures represent components that may or may not be present in various embodiments of the present disclosure described herein such that embodiments may include fewer or more components than those shown in the figures while not departing from the scope of the present disclosure. Some components may be omitted from one or more figures or shown in dashed line for visibility of the underlying components.

As used herein, the term "comprising" means including but not limited to and should be interpreted in the manner it is typically used in the patent context. Use of broader terms such as comprises, includes, and having should be understood to provide support for narrower terms such as consisting of, consisting essentially of, and comprised substantially of.

The phrases "in various embodiments," "in one embodiment," "according to one embodiment," "in some embodiments," and the like generally mean that the particular feature, structure, or characteristic following the phrase may be included in at least one embodiment of the present disclosure and may be included in more than one embodiment of the present disclosure (importantly, such phrases do not necessarily refer to the same embodiment).

The word "example" or "exemplary" is used herein to mean "serving as an example, instance, or illustration." Any implementation described herein as "exemplary" is not necessarily to be construed as preferred or advantageous over other implementations.

If the specification states a component or feature "may," "can," "could," "should," "would," "preferably," "possibly," "typically," "optionally," "for example," "often," "might" (or other such language) be included or have a characteristic, that a specific component or feature is not required to be included or to have the characteristic. Such a component or feature may be optionally included in some embodiments, or it may be excluded.

The present disclosure provides various embodiments of a safety helmet is disclosed. Embodiments may comprise an outer shell, an inner block may be coupled to or monolithic with the outer shell. Embodiments may comprise an eyewear may be pivotally mounted to the inner block and positioned between the outer shell and the inner block. Embodiments may comprise at least one lever, may be pivotally mounted to the inner block and positioned proximate to the eyewear. Embodiments may be configured to move from a first position to a second position. Embodiments may be configured to act as a stopper for the at least one lever. Embodiments to move the eyewear from a stowed-in position to a stowed-out position. Embodiments may be configured to lock the eyewear in the stowed-in position when the eyewear is in the stowed-in position and the at least one lever is in the first position. Embodiments may be configured to allow the eyewear to move to the stowed-out position when the eyewear is in the stowed-in position and the at least one lever is moved from the first position to the second position.

FIG. 1A illustrates a perspective view of a safety helmet 100, in accordance with an example embodiment of the present disclosure. FIG. 1B illustrates a side view of the safety helmet 100, in accordance with an example embodiment of the present disclosure. FIG. 1C illustrates another side view of the safety helmet 100, in accordance with an example embodiment of the present disclosure. FIG. 1A is described in conjunction with FIGS. 1B and 1C. In some embodiments, the safety helmet 100 may comprise an outer shell 102, an inner block 104, an eyewear 106 pivotally mounted to the inner block 104, and at least one lever 108.

In some embodiments, the safety helmet 100 may be configured to be worn by a user over the user's head. Further, the outer shell 102 of the safety helmet 100 may be configured to protect the user's head from various hazards. Further, the hazards may include but are not limited to falling of objects, emission of heat etc. In some embodiments, the outer shell 102 may be composed of one or more materials. The materials may be selected from a group of materials such as, but not limited to metals, plastic, alloys and alike. In some embodiments, the outer shell 102 may be crafted with a shape that may include but not limited to a hemi-spherical shape or any other shape known in the art. In some embodiments, the shape of the outer shell 102 may be selected such that the safety helmet 100 perfectly fits on the user's head. In some embodiments, the safety helmet 100 may comprise an extended portion 110. Further, the extended portion 110 may be configured to decrease impact of collision of any object with the safety helmet 100.

In some embodiments, the safety helmet 100 may comprise a first side 112 and a second side 114. In at least one example, the first side 112 of the safety helmet 100 may be installed with at least one strap (not shown). Further, the at least one strap may be accessed by the user to secure the safety helmet 100 with the user's head by securing the at least one strap with the second side 114 of the safety helmet 100 via at least one latch (not shown). In some embodiments, the at least one strap may be secured under the user's jaw and with the second side 114 of the safety helmet 100. Further, the at least one strap may be composed of one or more materials that may provide comfort to the user while wearing the safety helmet 100.

In various examples, the safety helmet 100 comprises a padding (not shown), one or more edges (not shown) and a shield 116. Further, the padding may be configured to provide comfort to the user while wearing the safety helmet 100 over the user's head. In some embodiments, the padding may be composed of a material that may include but not limited to foam, one or more air bladders, etc. Further, the one or more edges may be configured to extend a surface area of the safety helmet 100 while protecting the user's head from the hazards. In some embodiments, the shield 116 may be configured to protect the user's head from the hazards present behind the user's head.

In some embodiments, the safety helmet 100 may further comprise the inner block 104. Further, in at least one example, the inner block 104 may be monolithic with the outer shell 102 of the safety helmet 100. In another example, the inner block 104 may be coupled to the outer shell 102. Further, the inner block 104 may be configured to enhance strength of the outer shell 102. Further, the inner block 104 of the safety helmet 100 may be configured to perfectly encase around the user's head to provide stability to the safety helmet 100 over the user's head. In some embodiments, the inner block 104 may be crafted with a shape that may include but not limited to a circular shape, an oval shape or like. In some embodiments, the inner block 104 may be composed of a material that may include but not limited to polycarbonate or any other engineering plastic. In some embodiments, the material of the inner block 104 may be selected such that a durability of the inner block 104 may be ensured.

In some embodiments, the safety helmet 100 may further comprise the eyewear 106. Further, the eyewear 106 may be pivotally mounted with the inner block 104. In some embodiments, the eyewear 106 may be mounted with the inner block 104 such that the eyewear 106 may be positioned between the outer shell 102 and the inner block 104. Further, the eyewear 106 may be configured to protect the user's eyes from the hazards. In some embodiments. The eyewear 106 may be attached with the first side 112 and the second side 114 of the safety helmet 100 via an adaptor 118. In at least one example, the eyewear 106 may be configured to cover the user's eyes while performing one or more tasks, such as machining operations, operations involving chemicals, etc. that may require protection to the user's eyes. Further, the adaptor 118 may be configured to couple the first side 112 of the safety helmet 100 and the second side 114 of the safety helmet 100 with the eyewear 106. In some embodiments, the adaptor 118 may be configured to enable movement of the eyewear 106 from a first position 300 (as shown in FIG. 1C) to a second position 500.

In some embodiments, the safety helmet 100 may further comprise, the at least one lever 108. Further, the at least one lever 108 may be pivotally mounted to the inner block 104. Further, the at least one lever 108 may be positioned in proximity to the eyewear 106. Further, the at least one lever 108 may be accessed by the user to allow the eyewear 106 to move from the first position 300 to the second position 500. Further, the at least one lever 108 may also enable the user to move the eyewear 106 from the second position 500 to the first position 300. In some embodiments, the first position 300 of the eyewear 106 may correspond to a stowed-in position (as shown in FIGS. 1A-1C and FIGS. 3A and 3B) and the second position 500 of the eyewear 106 may correspond to a stowed-out position 500 as shown in FIGS. 5A and 5B.

FIG. 2A illustrates a perspective view of the eyewear 106 detachably coupled with the adaptor 118, in accordance with an example embodiment of the present disclosure. FIG. 2B illustrates an exploded view of the eyewear 106 detached from the adaptor 118, in accordance with an example embodiment of the present disclosure.

In some embodiments, the eyewear 106 may be constructed with a material that may be selected from a group of materials such as, but is not limited to, polycarbonate, acrylic, polystyrene, and any other material known in the art. It may be noted that the materials for making the eyewear 106 may be selected carefully as the eyewear 106 may demand durability and rigidity as the user may be exposed to various external factors that may physically damage the eyewear 106. Further, the various external factors may include scratches from sharp objects or dropping from a particular height, without departing from the scope of the disclosure.

In some embodiments, the eyewear 106 may comprise a first side 200 and a second side 202. Further, the first side 200 and the second side 202 of the eyewear 106 may be configured to connect with the first side 112 and the second side 114 of the safety helmet 100 respectively. Further, the eyewear 106 may be configured to detachably attach with the first side 112 of the safety helmet 100 and the second side 114 of the safety helmet 100, via the adaptor 118. Further, each end of the eyewear 106 may be configured to detachably couple with the adaptor 118. In some embodiments, each of the adaptor 118 may be machined with an aperture 204. Further, the aperture 204 may be configured to enable securing of each of the adaptor 118 with each of the first side 112 and the second side 114 of the safety helmet 100.

In some embodiments, the aperture 204 of each of the adaptor 118 may define a predefined radius. In at least one example, the aperture 204 of each of the adaptor 118 may be fastened with at least one pair of screws (not shown) to secure the eyewear 106 with the safety helmet 100. In some embodiments, each of the adaptor 118 may comprise at least one extended region 206. Further, the at least one extended region 206 may be configured to engage the first side 200 of the eyewear 106 and the second side 202 of the eyewear 106 with each the adaptor 118. In some embodiments, the at least one extended region 206 may be crafted with a shape that may include but not limited to a hemispherical shape, a square shape and alike.

As illustrated in FIG. 2B, the first side 200 and the second side 202 of the eyewear 106 may be fabricated with a slot 208. In some embodiments, the slot 208 may be fabricated with a predefined diameter. In some embodiments, the slot 208 may be configured to engage with the at least one extended region 206 of each of the adaptor 118. Further, the slot 208 may be crafted with a shape and dimensions that may ensure perfect fitting of the slot 208 with the at least one extended region 206.

FIG. 3A illustrates another perspective view of the safety helmet 100 having the eyewear 106 positioned at the stowed-in position 300, in accordance with an example embodiment of the present disclosure. FIG. 3B illustrates a side view of the safety helmet 100 having the eyewear 106 gripped by a protrusion 302 when positioned at the stowed-in position 300, in accordance with an example embodiment of the present disclosure. FIG. 3C illustrates a side view of the eyewear 106 while gripped by the protrusion 302 at the stowed-in position 300, in accordance with an example embodiment of the present disclosure. FIG. 3D illustrates a bottom view of the safety helmet 100 having the eyewear 106 positioned at the stowed-in position 300, in accordance with an example embodiment of the present disclosure. FIGS. 3A-3D are described in conjunction with FIGS. 1-2B.

In some embodiments, the inner block 104 of the safety helmet 100 may further comprise the protrusion 302. Further, the protrusion 302 may be configured to grip the eyewear 106 at the first position 300 inside and between the inner block 104 and the outer shell 102 of the safety helmet 100. It may be noted that the first position 300 and the stowed-in position 300 may be alternatively used further. In some embodiments, the first position 300 may correspond to the stowed-in position 300. Further, the protrusion 302 may be crafted with a shape that may include but not limited a spherical shape, a chamfered shape, a hemi-spherical shape and like. Further, the protrusion 302 may be configured to generate a frictional force against the eyewear 106 to secure the eyewear 106 at the stowed-in position 300.

As illustrated in FIG. 3B, when the eyewear 106 is positioned at the first position 300, the user may perform operations that generally may not demand protection to the user's eyes. Further, when the eyewear 106 is positioned at the first position 300, the eyewear 106 may be stationed at an internal cavity formed between the outer shell 102 and the inner block 104 of the safety helmet 100. In some embodiments, the eyewear 106 may define an eyewear rotational axis. Further, the eyewear 106 may be configured to rotate on the eyewear rotational axis to move from the stowed-in position 300 to the stowed-out position 500 or from the stowed-out position 500 to the stowed-in position 300. Further, the eyewear rotational axis of the eyewear 106 may define movement of the eyewear 106 from 40 degrees to 65 degrees.

FIG. 4A illustrates a perspective view of the at least one lever 108, in accordance with an example embodiment of the present disclosure. FIG. 4B illustrates a bottom view of the at least one lever 108 configured in a first position 406 when the eyewear 106 is positioned at the stowed-in position, in accordance with an example embodiment of the present disclosure.

In some embodiments, the safety helmet 100 may further comprise the at least one lever 108. In some embodiments, the at least one lever 108 may be pivotally mounted with the inner block 104. Further, the at least one lever 108 may be mounted with the inner block 104 such that the at least one lever 108 may be positioned in proximity to the eyewear 106. In some embodiments, the at least one lever 108 may comprise, a lever boss 400, a push protrusion 402, a stopper protrusion 404. Further, the at least one lever 108 may define a lever rotational axis. Further, the at least one lever 108 may be configured to rotate on the lever rotational axis to move from the first position 406 to a second position 502. Further, the lever rotational axis may define movement of the at least one lever 108 from 30 degrees to 70 degrees. In some embodiments, the push protrusion 402 may be configured to be pushed to rotate the at least one lever 108 from the first position 406 to the second position 502. Further, the stopper protrusion 404 may be configured to lock the movement of the at least one lever 108.

As illustrated in FIG. 4B, the at least one lever 108 may be mounted with the inner block 104 of the safety helmet 100. Further, the lever boss 400 may be configured to enable the fastening of the at least one lever 108 with the inner block 104. Further, the lever boss 400 may be crafted with a shape that may be selected from a group of shapes such as but not limited to a cylindrical shape, a rectangular shape or like. In some embodiments, the lever boss 400 may be fastened with at least one screw to attach the at least one lever 108 with the inner block 104 of the safety helmet 100. In some embodiments, the lever boss 400 may have a predefined diameter. In some embodiments, the at least one lever 108 may be attached with the inner block 104 such that the push protrusion 402 may be exposed out of the safety helmet 100 and the stopper protrusion 404 may be in contact with the eyewear 106.

In some embodiments, when the eyewear 106 is in the stowed-in position 300 and the at least one lever 108 is in the first position 406, the at least one lever 108 may be configured to lock the eyewear 106 in the stowed-in position 300. For example, the at least one lever 108 may prevent the eyewear 106 from moving from the stowed-in position to the stowed-out position because the stopper protrusion 404 of the at least one lever 108 obstructs the eyewear 106 when the eyewear is in the stowed-in position and the at least one lever 108 is in the first position 406. Further, the eyewear 106 may be positioned between the outer shell 102 and the inner block 104, when the at least one lever 108 is positioned at the first position 406. In some embodiments, the first position 406 may define the position where the at least one lever 108 may be engaged with the eyewear 106 to lock the eyewear 106 in the stowed-in position 300. In some embodiments, the push protrusion 402 may be pushed by the user in a first direction to rotate the at least one lever 108 on the lever rotational axis to move from the first position 406 to the second position 502.

Further, the at least one lever 108 may be configured to move on the lever rotational axis, upon application of an external force on the push protrusion 402. In some embodiments, the second position 502 of the at least one lever 108 may define the position where the at least one lever 108 may be disengaged from the eyewear 106 to deploy the eyewear 106 from the stowed-in position 300 to the stowed-out position 500. Further, when the eyewear 106 is in the stowed-in position 300 and the at least one lever 108 is moved from the first position 406 to the second position 502, the eyewear 106 may be allowed to move to the stowed-out position 500. In some embodiments, when the eyewear 106 is positioned at the stowed-out position 500, the eyewear 106 may be configured to cover the user's eyes.

In some embodiments, the at least one lever 108 may further comprise the stopper protrusion 404. Further, the stopper protrusion 404 may be barricaded by an inner block protrusion 408 crafted on the inner block 104. Further, the inner block protrusion 408 may be configured to prevent the rotational movement of the at least one lever 108 on the lever rotational axis above a threshold angle, when the at least one lever 108 may be pushed from the first position 406 to the second position 502. In at least one example, the at least one lever 108 may be pivoted to move from the first position 406 to the second position 502. In some embodiments, the inner block protrusion 408 may be crafted with a shape that may include but not limited to a cuboidal shape, a spherical shape, a cubical shape or like. In some embodiments, the inner block protrusion 408 may be composed of a dimension. Further, the dimension may define a length 5-9 mm, a width 3-5 mm and a thickness 5-8 mm.

In some embodiments, the safety helmet 100 may further comprise a first spring 410. In some embodiments, the first spring 410 may be positioned between each of the adaptor 118 and the inner block 104 of the safety helmet 100. Further, the first spring 410 may be initially compressed when the eyewear 106 is positioned at the stowed-in position 300. In some embodiments, the first spring 410 may further comprise one or more spiral coils. Further, the one or more spiral coils may be configured to store a potential energy when the eyewear 106 is positioned at the stowed-in position 300. In some embodiments, the first spring 410 may be configured to push the eyewear 106 from the stowed-in position 300 to the stowed-out position 500 once the at least one lever 108 is rotated from the first position 406 to the second position 502.

In some embodiments, the safety helmet 100 may further comprise a second spring 412. In some embodiments, the second spring 412 may be positioned between the at least one lever 108 and the inner block 104 of the safety helmet 100. Further, the second spring 412 may be initially compressed when the lever is positioned at the first position 406. In some embodiments, the second spring 412 may further comprise one or more spiral coils. Further, the one or more spiral coils may be configured to store a potential energy when the at least one lever 108 is positioned at the first position 406. In some embodiments, the second spring 412 may be configured to retract the at least one lever 108 from the second position 502 to the first position 406 once the eyewear 106 is deployed in the stowed-out position.

FIG. 5A illustrates a side view of the safety helmet 100 having the eyewear 106 positioned at the stowed-out position 500, in accordance with an example embodiment of the present disclosure. FIG. 5B illustrates another side view of the safety helmet 100 having the eyewear 106 positioned at the stowed-out position 500, in accordance with an example embodiment of the present disclosure.

In some embodiments, when the eyewear 106 is in the stowed-in position 300 and the at least one lever 108 is moved from the first position 406 to the second position 502, the eyewear 106 is allowed to move to the stowed-out position 500. Further, when the eyewear 106 is rotated at the second position 500, the eyewear 106 may be positioned at a predefined threshold angle (approximately 10-20 degrees) relative to the safety helmet 100. In some embodiments, the second position 500 may correspond to the stowed-out position 500. In at least one example, the eyewear 106 may be positioned by the user at the stowed-out position 500 while performing one or more tasks that may require protection to the user's eyes, such as machining operations, operations involving chemicals, etc. that may require protection to the user's eyes.

In some embodiments, when the eyewear 106 is positioned at the stowed-out position 500, the at least one protrusion may be configured to move from the first position 406 to the second position 502. Further, the at least one protrusion may be configured to get locked at the second position 502 by the inner block protrusion 408, when the eyewear 106 is positioned at the stowed-out position 500 (as shown in FIG. 5B).

FIG. 5C illustrates another bottom view of the at least one lever 108 configured in the second position 406 when the eyewear 106 is positioned at the stowed-out position 500, in accordance with an example embodiment of the present disclosure. FIG. 5D illustrates a magnified view of the safety helmet 100, in accordance with an example embodiment of the present disclosure.

As illustrated in FIGS. 5C and 5D, the inner block 104 may be fabricated with a groove 504. In some embodiments, the groove 504 may be configured to restrict further movement of the eyewear 106 on the eyewear rotational axis, when deployed in the stowed-out position 500. in some embodiments, the groove 504 may be fabricated on the inner block 104 by one or more processes (i.e. machining, molding, etc.). Further, the eyewear 106 may be configured to protect the user's eyes when positioned at the second position 500. In some embodiments, the first side 200 of the eyewear 106 and the second side 202 of the eyewear 106 may be rested on the groove 504 (as illustrated in FIG. 5C).

In at least one example, the eyewear 106 may be manually pushed by the user to move the eyewear 106 from the second position 500 to the first position 300. Further, the eyewear 106 may be gripped by the protrusion 302 when positioned from the stowed-out position 500 to the stowed-in position 300. Further, the first spring 410 may be compressed when the eyewear 106 is pushed by the user from the stowed-out position 500 to the stowed-in position 300. In some embodiments, the at least one lever 108 may also be configured to move from the second position 502 to the first position 406, when the eyewear 106 is moved from the stowed-out position 500 to the stowed-in position 300.

In an exemplary embodiment, a method is disclosed. Further, the method may comprise one or more operations. At first operation the at least one lever 108 may be configured to move from the first position 406 to the second position 502, where the inner block protrusion 408 may be configured to act as a stopper for the at least one lever 108. Further, the eyewear 106 may be configured to move from the stowed-in position 300 to the stowed-out position 500. Further, when the eyewear 106 is in the stowed-in position 300 and the at least one lever 108 is in the first position 406, the at least one lever 108 may be configured to lock the eyewear 106 in the stowed-in position 300. Further, when the eyewear 106 is in the stowed-in position 300 and the at least one lever 108 may be configured to move from the first position 406 to the second position 502, the eyewear 106 may be allowed to move to the stowed-out position 500. In some embodiments, the inner block 104 may comprise the inner block protrusion 408. Further, the inner block protrusion 408 may be configured to prevent movement of the eyewear 106 over the eyewear rotational axis, above the threshold angle.

For example, a safety helmet 100 configured to be worn by a fire fighter. Further, the safety helmet 100 is coupled with an eyewear 106 via an adaptor 118. Further, the safety helmet 100 further comprises an inner block 104 that is installed with at least one lever 108. Further, the at least one lever 108 is configured to be moved from a first position 406 to a second position 502 and vice-versa. Further, when the at least one lever 108 is pushed from the first position 406 to the second position 502, the eyewear 106 deploys from a stowed-in position 300 to a stowed-out position 500.

At another operation, the eyewear 106 may be pushed from the stowed-out position 500 to the stowed-in position to move the at least one lever 108 from the second position 502 to the first position 406 to lock the eyewear 106 in the stowed-in position 300. Further, the outer shell 102 of the safety helmet 100 may further comprise the protrusion 302. Further, the protrusion 302 may be configured to prevent the rotational movement of the eyewear 106 on the eyewear rotational axis above the threshold angle, when the eyewear 106 moves from the stowed-out position 500 to the stowed-in position 300.

For example, the eyewear 106 is pushed by the user from the stowed-out position 500 to the stowed-in position 300 when protection to the user's eyes is not required. Further, when the eyewear 106 is pushed from the stowed-out position 500 to the stowed-in position 300, the at least one lever 108 moves from the second position 502 to the first position 406 to lock the eyewear 106 in the stowed-in position 300.

The present disclosure provides various embodiments. Embodiments may prevent the entry of dust, debris, or other harmful chemicals in the user's eyes. Embodiments may allow the eyewear 106 to be secured in the stowed-in position 300 and the stowed-out position 500. Embodiments may allow deployment of the eyewear 106 from the stowed-in position 300 to the stowed-out position 500, via the at least one lever 108. Embodiments may be configured to enhance overall efficiency and productivity by providing a smooth transition between the stowed-in position 300 and the stowed-out position 500 of the eyewear 106. Embodiments may avoid any accidental or undesired rotation or movement of the eyewear 106 with respect to the safety helmet 100 using the protrusion 302.

Many modifications and other embodiments of the disclosure set forth herein will come to mind to one skilled in the art to which the present disclosure pertains to having the benefit of the teachings presented in the foregoing descriptions and the associated drawings. Therefore, it is to be understood that the present disclosure is not to be limited to the specific embodiments disclosed and that modifications and other embodiments are intended to be included within the scope of the appended claims. Moreover, although the foregoing descriptions and the associated drawings describe example embodiments in the context of certain example combinations of elements and/or functions, it should be appreciated that different combinations of elements and/or functions may be provided by alternative embodiments without departing from the scope of the appended claims. In this regard, for example, different combinations of elements and/or functions than those explicitly described above are also contemplated as may be set forth in some of the appended claims. Although specific terms are employed herein, they are used in a generic and descriptive sense only and not for purposes of limitation.

What is claimed is:

1. A safety helmet comprising:

an outer shell;

an inner block coupled to or monolithic with the outer shell, wherein the inner block comprises an inner block protrusion;

an eyewear pivotally mounted to the inner block and positioned between the outer shell and the inner block; and, at least one lever pivotally mounted to the inner block and positioned proximate to the eyewear, wherein the at least one lever is configured to move from a first position to a second position, wherein the inner block protrusion acts as a stopper for the at least one lever, wherein the eyewear is configured to move from a stowed-in position to a stowed-out position, wherein when the eyewear is in the stowed-in position and the at least one lever is in the first position, the at least one lever locks the eyewear in the stowed-in position, and wherein when the eyewear is in the stowed-in position and the at least one lever is moved from the first position to the second position, the eyewear is allowed to move to the stowed-out position.

2. The safety helmet of claim 1, wherein the eyewear defines an eyewear rotational axis on which the eyewear rotates from the stowed-in position to the stowed-out position or from the stowed-out position to the stowed-in position.

3. The safety helmet of claim 2, wherein the inner block is fabricated with a groove, wherein the groove is configured to restrict further movement of the eyewear on the eyewear rotational axis when deployed in the stowed-out position.

4. The safety helmet of claim 2, further comprising a protrusion configured to prevent a rotational movement of the eyewear on the eyewear rotational axis above a predefined threshold angle, when the eyewear moves from the stowed-out position to the stowed-in position.

5. The safety helmet of claim 1, wherein the at least one lever defines a lever rotational axis on which the at least one lever rotates from the first position to the second position or from the second position to the first position.

6. The safety helmet of claim 5, wherein the inner block protrusion is configured to prevent a rotational movement of the at least one lever on the lever rotational axis above a threshold angle, when the at least one lever is pushed from the first position to the second position.

7. The safety helmet of claim 1, further comprising a first spring coupled to the eyewear, wherein the first spring is configured to push the eyewear from the stowed-in position to the stowed-out position once the at least one lever is rotated from the first position to the second position.

8. The safety helmet of claim 7, further comprising a second spring coupled to the at least one lever, wherein the second spring is configured to retract the at least one lever from the second position to the first position once the eyewear is deployed in the stowed-out position.

9. The safety helmet of claim 1, wherein the at least one lever defines a lever rotational axis on which the at least one lever rotates from the first position to the second position or from the second position to the first position.

10. The safety helmet of claim 2, wherein the eyewear defines an eyewear rotational axis on which the eyewear rotates from the stowed-in position to the stowed-out position or from the stowed-out position to the stowed-in position, wherein the lever rotational axis is orthogonal to the eyewear rotational axis.

11. The safety helmet of claim 1, wherein each end of the eyewear is fabricated with a slot, wherein the slot is configured to receive an extended region of an adaptor to detachably couple each end of the eyewear with the adaptor.

12. The safety helmet of claim 1, wherein the adaptor is configured to detachably mount the eyewear with the inner block.

13. The safety helmet of claim 1, wherein the at least one lever further comprises a push protrusion and a stopper protrusion, wherein the push protrusion is configured to be pushed to rotate the at least one lever from the first position to the second position and the stopper protrusion is configured to lock with the inner block protrusion to lock the movement of the at least one lever.

14. A method comprising:

moving at least one lever from a first position to a second position, where an inner block protrusion acts as a stopper for the at least one lever, wherein an eyewear is configured to move from a stowed-in position to a stowed-out position, wherein when the eyewear is in the stowed-in position and the at least one lever is in the first position, the at least one lever locks the eyewear in the stowed-in position, wherein, when the eyewear is in the stowed-in position and the at least one lever is moved from the first position to the second position, the eyewear is allowed to move to the stowed-out position; or, pushing the eyewear from the stowed-out position to the stowed-in position to move the at least one lever from the second position to the first position to lock the eyewear in the stowed-in position, wherein the at least one lever defines a lever rotational axis on which the at least one lever rotates from the first position to the second position or from the second position to the first position.

15. The method of claim 14, wherein the eyewear defines an eyewear rotational axis on which the eyewear rotates from the stowed-in position to the stowed-out position or from the stowed-out position to the stowed-in position.

16. The method of claim 15, wherein the inner block protrusion is fabricated with a groove, wherein the groove is configured to restrict further movement of the eyewear on the eyewear rotational axis when deployed in the stowed-out position.

17. The method of claim 15, further comprising, preventing, via a stopper protrusion, a rotational movement of the eyewear on the eyewear rotational axis above a threshold angle, when the eyewear moves from the stowed-out position to the stowed-in position.

18. The method of claim 14, further comprising preventing, via the inner block protrusion, a rotational movement of the at least one lever on the lever rotational axis above a threshold angle, when the at least one lever is pushed from the first position to the second position.

19. The method of claim 14, further comprising, pushing, via a first spring coupled to the eyewear, the eyewear from the stowed-in position to the stowed-out position once the at least one lever is rotated from the first position to the second position.

* * * * *